US009388367B2

(12) United States Patent
Schramm, Jr. et al.

(10) Patent No.: US 9,388,367 B2
(45) Date of Patent: Jul. 12, 2016

(54) ESTERQUAT COMPOSITION HAVING HIGH TRIESTERQUAT CONTENT

(71) Applicant: Colgate-Palmolive Company, New York, NY (US)

(72) Inventors: Charles J. Schramm, Jr., Hillsborough, NJ (US); Katie Truong, Piscataway, NJ (US); Karen L. Wisniewski, Bound Brook, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/651,127

(22) PCT Filed: Dec. 11, 2012

(86) PCT No.: PCT/US2012/068969

§ 371 (c)(1),
(2) Date: Jun. 10, 2015

(87) PCT Pub. No.: WO2014/092693

PCT Pub. Date: Jun. 19, 2014

(65) Prior Publication Data

US 2015/0307812 A1 Oct. 29, 2015

(51) Int. Cl.

| | |
|---|---|
| ***C11D 1/62*** | (2006.01) |
| ***C11D 1/645*** | (2006.01) |
| ***C11D 3/50*** | (2006.01) |
| ***C11D 3/00*** | (2006.01) |
| ***C11D 1/38*** | (2006.01) |
| ***C11D 3/30*** | (2006.01) |

(52) U.S. Cl.
CPC *C11D 3/001* (2013.01); *C11D 1/38* (2013.01); *C11D 1/62* (2013.01); *C11D 3/30* (2013.01)

(58) Field of Classification Search
CPC ..... C11D 1/62; C11D 1/645; C11D 3/001; C11D 3/0015; C11D 3/50; C11D 9/442; C11D 17/0021
See application file for complete search history.

(56) References Cited

U.S. PATENT DOCUMENTS

| | | | | |
|---|---|---|---|---|
| 3,915,867 | A | 10/1975 | Kang et al. | |
| 5,916,863 | A | 6/1999 | Iacobucci et al. | |
| 6,004,913 | A | 12/1999 | Iacobucci et al. | |
| 6,037,315 | A | 3/2000 | Franklin et al. | |
| 6,770,608 | B2 | 8/2004 | Franklin et al. | |
| 7,214,718 | B1 | 5/2007 | Ohtawa et al. | |
| 8,865,640 | B2 | 10/2014 | Subramanyam et al. | |
| 2002/0132749 | A1 | 9/2002 | Smith et al. | |
| 2003/0036499 | A1 | 2/2003 | Ohtawa et al. | |
| 2010/0197560 | A1* | 8/2010 | Nepras ..... | A61K 8/416 510/515 |

FOREIGN PATENT DOCUMENTS

| | | | |
|---|---|---|---|
| EP | 1354869 | | 7/2004 |
| EP | 0707059 | | 9/2004 |
| WO | WO 93/23510 | | 11/1993 |
| WO | WO 00/06678 | | 2/2000 |
| WO | 01/32813 | * | 5/2001 |
| WO | WO 01/32813 | | 5/2001 |
| WO | WO 2007/090567 | | 8/2007 |
| WO | WO 2007/092020 | | 8/2007 |
| WO | WO 2008/005693 | | 1/2008 |

OTHER PUBLICATIONS

International Search Report and Written Opinion in International Application No. PCT/US2012/068969, mailed Sep. 20, 2013.
Written Opinion in International Application No. PCT/US2012/068969, mailed Nov. 19, 2014.
Wilkes et al., 1996, "Characterization of quaternized triethanol amine esters (esterquats) by HPLC, HRCGC and NMR," 4th World Surfactants Congress, Barcelone, 3-7 VI, p. 382-402.

* cited by examiner

*Primary Examiner* — Charles Boyer

(57) ABSTRACT

A composition comprising (a) an esterquat that is a quaternized reaction product of an alkanol amine and a fatty acid, wherein from at least 90 wt % to up to 100 wt % of the esterquat is comprised of triesterquat and from 0 wt % to up to 10 wt % of the esterquat is comprised of at least one of monoesterquat and diesterquat, and (b) a cationic surfactant. Also, a method of producing such a composition and a method of softening a fabric, and increasing fragrance delivery, comprising treating the fabric with the composition.

29 Claims, No Drawings

ESTERQUAT COMPOSITION HAVING HIGH TRIESTERQUAT CONTENT

BACKGROUND OF THE INVENTION

Esterquat, a quaternary ammonium compound, is known for use as a fabric softening molecule. It is typically formed when the reaction product of long chain (C12-C22 or C16-C18) fatty acids and a tertiary amine is esterified in the presence of an acid catalyst and subsequently quaternized to obtain quaternary ammonium salts. The final product is a mixture of mono-, di- and triester components.

Quaternary ammonium compounds exhibiting particularly good fabric softening performance and stability profiles are obtained from reaction of C12-C22 fatty acids or the hydrogenation products, usually containing some degree of unsaturation, having an iodine value range of 20-90.

Triethanol amine (TEA) tallow fatty acid esterquats have been one mainstay for fabric conditioners since the late 1990's. The triesterquat component of triethanol amine (TEA) esterquat has been generally held to have poor softening and fragrance delivery performance. The prior art has generally focused on efforts to enhance the diesterquat component which was claimed to maximize softening efficacy.

The costs of raw materials required for production of triethanol amine based esterquats such as fatty acids and dimethyl sulfate are increasing significantly in line with oil price increases. TEA esterquats are composed of mono-, di-, and tri-esterquats and mono-, di-, and tri-ester amines. This complicated chemistry results in emulsions that contain several types of emulsion structures, some of which do not effectively contribute to softening performance upon dilution in water during the rinse cycle of a fabric washing process because of their high solubility in water. This becomes particularly noticeable in fabric softening compositions in which the initial product active levels are reduced, resulting in less structure in the initial product emulsion.

Another difficulty of this esterquat system is that the complicated chemistry also makes it hard for a formulator to adjust or add other ingredients to the formulation: each emulsion structure reacts in its own way to the formula change and makes it very difficult for the formulator to balance all the different changes.

There is therefore a need in the art for an esterquat composition, in particular for use as a fabric softening composition, which can have at least one of lower cost, a less complex formulation and/or manufacturing process, equivalent or higher softening and/or fragrance delivery performance, and consistent and predictable properties and performance as compared to known esterquat compositions.

There is, in particular, a need in the art for an esterquat composition for use in a fabric conditioner which can have a lower cost but at least a substantially equivalent softening and fragrance delivery performance as compared to known esterquat compositions for fabric conditioners.

BRIEF SUMMARY OF THE INVENTION

The present invention accordingly provides a composition comprising (a) an esterquat that is a quaternized reaction product of an alkanol amine and a fatty acid, wherein from at least 90 wt % to up to 100 wt % of the esterquat is comprised of triesterquat and from 0 wt % to up to 10 wt % of the esterquat is comprised of at least one of monoesterquat and diesterquat, and (b) a cationic surfactant.

The amount of triesterquat is at least 90 wt % of the esterquat, optionally at least 95 wt % of the esterquat, further optionally at least 99 wt % of the esterquat Optionally, from 0 wt % to up to 5 wt %, typically from 0 wt % to up to 1 wt %, of the esterquat is comprised of monoesterquat.

Optionally, the alkanol amine comprises triethanol amine.

Optionally, the fatty acids are those in tallow. However, in any of the embodiments of the invention the fatty acid may comprise any fatty acid having from 12 to 22 carbon atoms, typically from 16 to 18 carbon atoms.

Optionally, the tallow fatty acid has a degree of saturation, based on the total weight of fatty acids, of from 40 to 90%. Optionally, the tallow fatty acid has an iodine value of from 10 to 70.

Optionally, the composition comprises from 1.5 to 5 wt % triesterquat, further optionally from 2 to 3 wt % triesterquat, based on the weight of the composition. In some embodiments, the composition comprises about 2.5 wt % triesterquat, based on the weight of the composition.

Optionally, the composition comprises from 0.25 to 0.75 wt % cationic surfactant, further optionally from 0.3 to 0.5 wt % cationic surfactant, based on the weight of the composition. In some embodiments, the composition comprises about 0.4 wt % cationic surfactant, based on the weight of the composition.

Optionally, the weight ratio of triesterquat to cationic surfactant is from 20:1 to 3:1, further optionally from 10:1 to 4.5:1, yet further optionally from 7.5:1 to 5:1. In certain embodiments, the cationic surfactant is blended with the esterquat before the esterquat is formulated into the product. This can make the composition more stable and more effective.

Optionally, the composition further comprises from 0.25 to 1 wt % fragrance, typically about 0.5 wt % fragrance, based on the weight of the composition.

In certain embodiments, the fragrance is blended with the esterquat before the esterquat is formulated into a product. This can make the composition more stable and more effective.

In certain embodiments, the fragrance and the cationic surfactant are blended with the esterquat before the esterquat is formulated into a product. This can make the composition more stable and more effective.

Optionally, the composition further comprises a solvent, typically water.

Optionally, the triesterquat is dispersed as an emulsion in the solvent, and the emulsion comprises particles including a mixture of the triesterquat and the cationic surfactant. Further optionally, the particles have an average particle size of from 1 to 50 microns, typically from 10 to 40 microns.

Optionally, the particles have a particle size distribution exhibiting plural peaks at respective different particle sizes, typically two peaks. Further optionally, the particle size distribution exhibits two peaks at, respectively, particles sizes of about 2 to 3 microns and 10 to 20 microns.

Optionally, the plural peaks of the particle size distribution each have an apparent particle population that is similar to the other peaks.

In some embodiments the composition is a fabric softener composition.

The present invention also provides a method of producing a composition according to the invention, the method comprising the steps of: a) providing from 5 to 25 units by volume of water at a temperature of from 20 to 45° C.; b) dispersing the esterquat and the cationic surfactant into the water to form an aqueous emulsion comprising particles including a mixture of the triesterquat and the cationic surfactant; and c) adding to the aqueous emulsion from 75 to 95 units by volume of water at a temperature of from 15 to 35° C. to produce the composition.

Optionally, in step a) the water is at a temperature of from 20 to 40° C., 20 to 35° C. or 20 to 25° C. Optionally, in step c) the water is at a temperature of from 20 to 35° C. or 20 to 25° C.

Optionally, in step a) from 7.5 to 15 units of water are provided and in step c) from 85 to 92.5 units of water are provided. Further optionally, in step a) about 10 units of water are provided and in step c) about 90 units of water are provided.

Optionally, in step b) the dispersion is carried out so that the particles have an average particle size of from 1 to 50 microns, further optionally from 5 to 40 microns.

Optionally, in step b) the dispersion is carried out so that the particles have a particle size distribution exhibiting plural peaks at respective different particle sizes. Further optionally, in step b) the dispersion is carried out so that the particle size distribution exhibits two peaks at, respectively, particles sizes of about 2 to 3 microns and 10 to 20 microns.

Optionally, in step b) the dispersion is carried out so that the plural peaks of the particle size distribution each have an apparent particle population that is similar to the other peaks.

Optionally, in step b) the dispersion is carried out for a period of from 1 to 4 minutes using a shearing mixer to form the emulsion.

Optionally, in step b) the esterquat is dispersed into the water in the form of a molten liquid, optionally at a temperature of 45 to 55° C. Optionally, in step b) the cationic surfactant is dispersed into the water in the form of an aqueous solution of the cationic surfactant. Optionally, in step b) the cationic surfactant is added before the esterquat.

Optionally, the method is for producing a fabric softener composition.

The present invention also provides a method of softening a fabric comprising treating the fabric with a composition of the invention or produced by a method of the invention.

Optionally, the composition further comprises a fragrance and the method provides fragrance delivery onto the fabric.

The present invention also provides the use of a composition of the invention or produced by a method of the invention as a fabric softener.

The present invention is at least partly predicated on the finding by the present inventors that the cationic surfactant can act as an effective formulation aid for triesterquat to provide a stable dispersion of the triesterquat in a solvent, particularly water, which is effective in softening performance and fragrance delivery.

In particular, the inventors found that a low cost TEA esterquat could be provided by a triesterquat which exhibited a less complicated chemical composition than known mixtures of mono-. di- and tri-esterquats. A preferred composition includes at least 90 wt % triester in the esterquat, and may include as little as less than 1% of the highly soluble monoesterquat.

This reduced monoesterquat composition significantly reduces the potential loss of effective softening actives during the fabric rinse process. Although some inherent dispersibility is maintained by the triesterquat component, so that when only the triesterquat is added to water a triesterquat dispersion is able to form, the resulting emulsion exhibits limited stability and softening effectiveness, and so is not technically and commercially acceptable. However, by combining the triesterquat with the cationic surfactant in accordance with the preferred embodiments of the invention, the stability and performance of the triesterquat can be significantly enhanced, to provide a technically and commercially acceptable esterquat composition.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

AI refers to the active weight of the combined amounts for monoesterquat, diesterquat, and triesterquat.

Delivered AI refers to the mass (in grams) of esterquat used in a laundry load. A load is 3.5 kilograms of fabric in weight. As the size of a load changes, for example using a smaller or larger size load in a washing machine, the delivered AI adjusts proportionally.

The present invention accordingly provides a composition comprising (a) an esterquat that is a quaternized reaction product of an alkanol amine and a fatty acid, wherein from at least 90 wt % to up to 100 wt % of the esterquat is comprised of triesterquat and from 0 wt % to up to 10 wt % of the esterquat is comprised of at least one of monoesterquat and diesterquat, and (b) a quaternized cationic surfactant of formula $RNH_3^+X^-$ where R is an alkyl group having from 10 to 22 carbon atoms and $X^-$ is a softener compatible anion.

In general, esterquats are represented by the following structure:

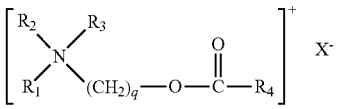

wherein $R_4$ represents an aliphatic hydrocarbon group having from 8 to 22 carbon atoms, $R_2$ and $R_3$ represent $(CH_2)_x$—$R_5$ where $R_5$ represents an alkoxy carbonyl group containing from 8 to 22 carbon atoms, benzyl, phenyl, (C1-C4)—alkyl substituted phenyl, OH or H; R1 represents $(CH_2)_t$ $R_6$ where $R_6$ represents benzyl, phenyl, (C1-C4)—alkyl substituted phenyl, OH or H; q, s, and t, each independently, represent an integer from 1 to 3; and $X^-$ is a softener compatible anion.

The esterquat is typically produced by reacting about of fatty acid methyl ester with alkanol amine followed by quaternization with dimethyl sulfate (further details on this preparation method are disclosed in U.S. Pat. No. 3,915,867). In certain embodiments, the alkanol amine comprises triethanol amine. The fatty acids can be any fatty acid that is used for manufacturing esterquats for fabric softening. In any of the embodiments of the invention the fatty acid may comprises any fatty acid having from 12 to 22 carbon atoms, typically from 16 to 18 carbon atoms. Examples of fatty acids include, but are not limited to, coconut oil, palm oil, tallow, rape oil, fish oil, or chemically synthesized fatty acids. In certain embodiments, the fatty acid is tallow.

In accordance with the invention, the reaction is carried out so as to have a high amount of triesterquat, and low amounts of monoesterquat and diesterquat.

In some embodiments, from 0 wt % to up to 5 wt %, typically from 0 wt % to up to 1 wt %, of the esterquat is comprised of monoesterquat. The amount of triesterquat is at least 90 wt % of the esterquat, optionally at least 95 wt % of the esterquat, further optionally at least 99 wt % of the esterquat.

The selection of a particular molar ratio between the fatty acid methyl ester with alkanol amine controls the amount of each of monoesterquat, diesterquat, and triesterquat in the composition. By selecting a ratio of about 2.5:1 to 3:1 fatty acid methyl ester to alkanol amine, the triesterquat can be maximized while decreasing or minimizing the monoesterquat.

The percentages, by weight, of mono, di, and tri esterquats, as described above are determined by the quantitative analytical method described in the publication "Characterisation of quaternized triethanol amine esters (esterquats) by HPLC, HRCGC and NMR" A. J. Wilkes, C. Jacobs, G. Walraven and J. M. Talbot—Colgate Palmolive R&D Inc.—4$^{th}$ world Surfactants Congress, Barcelone, 3-7 VI 1996, page 382. The percentages, by weight, of the mono, di and tri esterquats measured on dried samples are normalized on the basis of 100%. The normalization is required due to the presence of 10% to 15%, by weight, of non-quaternized species, such as ester amines and free fatty acids. Accordingly, the normalized weight percentages refer to the pure esterquat component of the raw material. In other words, for the weight % of each of monoesterquat, diesterquat, and triesterquat, the weight % is based on the total amount of monoesterquat, diesterquat, and triesterquat in the composition.

In certain embodiments, the fatty acids may be saturated or partly unsaturated. Typically the fatty acids, such as the tallow fatty acids, have a degree of saturation, based on the total weight of fatty acids, of from 0 to 80%. Optionally, the tallow fatty acid has an iodine value of from 20 to 70.

Esterquat compositions using this percentage of saturated fatty acids do not suffer from the processing drawbacks of 100% saturated materials. When used in fabric softening, the compositions provide good consumer perceived fabric softness while retaining good fragrance delivery. In other embodiments, the amount is at least 50, 55, 60, 65 or 70 up to 75%. In other embodiments, the amount is no more than 70, 65, 60, 55, or 50 down to 45%. In other embodiments, the amount is 50 to 70%, 55 to 65%, or 57.5 to 67.5%. In one embodiment, the percentage of the fatty acid chains that are saturated is about 62.5% by weight of the fatty acid. In this embodiment, this can be obtained from a 50:50 ratio of hard: soft tallow as the source of the fatty acids.

By hard, it is meant that the fatty acids from the tallow are close to full hydrogenation. In certain embodiments, a fully hydrogenated fatty acid has an iodine value of 10 or less. By soft, it is meant that the fatty acids from the tallow are only partially hydrogenated. In certain embodiments, a partially hydrogenated fatty acid has an iodine value of at least 40. In certain embodiments, a partially hydrogenated fatty acid has an iodine value of 40 to 55. The iodine value can be measured by ASTM D5554-95 (2006). In certain embodiments, a ratio of hard fatty acid to soft fatty acid is 70:30 to 40:60. In other embodiments, the ratio is 60:40 to 40:60 or 55:45 to 45:55. In one embodiment, the ratio is about 50:50. Because in these specific embodiments, each of the hard tallow fatty acids and soft tallow fatty acids cover ranges for different levels of saturation (hydrogenation), the actual percentage of fatty acids that are fully saturated can vary. In certain embodiments, soft tallow contains approximately 47% saturated chains by weight.

The percentage of saturated fatty acids can be achieved by using a mixture of fatty acids to make the esterquat, or the percentage can be achieved by blending esterquats with different amounts of saturated fatty acids.

At higher AI levels, larger amounts of saturated fatty acids deliver more noticeable results than lower AI levels because the absolute amount of saturated fatty acid is greater, which provides a noticeable difference. While there is still a difference in result at lower AI, the result is less noticeable.

In certain embodiments, the amount of esterquat in the composition is up to 35% by weight, optionally up to 10%, up to 9%, up to 8%, up to 7%, up to 6%, or up to 5% by weight. In certain embodiments, the amount is 0.01 to 35%, 1 to 10%, 1 to 8%, 1 to 5%, 1.5 to 5%, or 2 to 3.5% by weight, preferably 1.5 to 5% or 2 to 3.5% by weight.

In certain embodiments, the delivered AI is 2.8 to 8 grams per load. In other embodiments, the delivered AI is 2.8 to 7, 2.8 to 6, 2.8 to 5, 3 to 8, 3 to 7, 3 to 6, 3 to 5, 4 to 8, 4 to 7, 4 to 6, or 4 to 5 grams per load.

In certain embodiments, the composition comprises from 1.5 to 5 wt % triesterquat, further optionally from 2 to 3 wt % triesterquat, based on the weight of the composition. In some embodiments, the composition comprises about 2.5 wt % triesterquat, based on the weight of the composition.

While the esterquat can be provided in solid form, it is usually present in a solvent in liquid form. In solid form, the esterquat can be delivered from a dryer sheet in the laundry. In certain embodiments, the solvent comprises water.

Triesterquat is not highly soluble in water. The cationic surfactant is provided to increase the dispersibility of the triesterquat in the water so that the esterquat forms particles of an aqueous emulsion which has stability prior to use and can be delivered to fabric during use to effect fabric softening.

In embodiments the cationic surface charge of the emulsion particle, provided by the cationic surfactant, assures that the emulsion particle may exhibit effective fabric deposition during the rinse process.

A variety of quaternary surfactants can be used to formulate the triesterquat softener. In certain embodiments, the cationic surfactant is a quaternized cationic surfactant of formula $RNH_3^+X^-$, where R is an alkyl group having from 10 to 22 carbon atoms and $X^-$ is a softener compatible anion. In certain embodiments, the alkyl group has C12 to C18 chain lengths, optionally C16, and optionally either trimethyl or dimethylethyl substitution. In other embodiments, the cationic surfactant has a pyridinium head group with the long chain alkyl group of C12 to C18 chain lengths. In certain embodiments, the cationic surfactant is selected to be a mono alkyl quaternary ammonium cationic surfactants that have good solubility in water and good biodegradability. In certain embodiments, examples of the counterion for the cationic surfactant include, but are not limited to, chloride, bromide, or methylsulfate.

In certain embodiments, the composition comprises from 0.25 to 0.75 wt % cationic surfactant, further optionally from 0.3 to 0.5 wt % cationic surfactant, based on the weight of the composition. In some embodiments, the composition comprises about 0.4 wt % cationic surfactant, based on the weight of the composition.

In certain embodiments, the weight ratio of triesterquat to cationic surfactant is from 20:1 to 3:1, further optionally from 10:1 to 4.5:1, yet further optionally from 7.5:1 to 5:1.

The composition can be provided as a fragrance free composition, or it can contain a fragrance. The fragrance can be free or encapsulated. The amount of fragrance can be any desired amount depending on the preference of the user. In certain embodiments, the composition comprises from 0.25 to 1 wt % total fragrance, typically from 0.4 to 0.5 wt % fragrance, based on the weight of the composition.

Fragrance, or perfume, refers to odoriferous materials that are able to provide a desirable fragrance to fabrics, and encompasses conventional materials commonly used in detergent compositions to provide a pleasing fragrance and/or to counteract a malodor. The fragrances are generally in the liquid state at ambient temperature, although solid fragrances can also be used. Fragrance materials include, but are not limited to, such materials as aldehydes, ketones, esters and the like that are conventionally employed to impart a pleasing fragrance to laundry compositions. Naturally occurring plant and animal oils are also commonly used as components of fragrances.

Typically, as discussed above, the composition further comprises a solvent, typically water. In certain embodiments, the triesterquat is dispersed as an emulsion in the solvent, and the emulsion comprises particles including a mixture of the triesterquat and the cationic surfactant.

In some embodiments the composition is a fabric softener composition.

The fabric conditioners may additionally contain a thickener.

The fabric conditioner may further include a chelating compound.

In certain embodiments, the composition can include a C13-C15 Fatty Alcohol EO 20:1, which is a nonionic surfactant with an average of 20 ethoxylate groups. In certain embodiments, the amount is 0.05 to 0.5 weight %.

In certain embodiments, the composition can contain a silicone as a defoamer, such as Dow Corning™ 1430 defoamer. In certain embodiments, the amount is 0.05 to 0.8 weight %.

The composition can be used to soften fabrics by treating the fabric with the composition. This can be done during the rinse cycle of a wash using a liquid fabric softener or in a dryer when using a dryer sheet.

Accordingly, the present invention also provides a method of producing a composition according to the invention, the method comprising the steps of: a) providing from 5 to 25 units by volume of water at a temperature of from 20 to 45° C.; b) dispersing the esterquat and the cationic surfactant into the water to form an aqueous emulsion comprising particles including a mixture of the triesterquat and the cationic surfactant; and c) adding to the aqueous emulsion from 75 to 95 units by volume of water at a temperature of from 20 to 45° C. to produce the composition.

In certain embodiments, in step a) the water is at a temperature of from 20 to 45° C., optionally, 20 to 35° C. or 20 to 25° C. In certain embodiments, in step c) the water is at a temperature of from 20 to 45° C., optionally 20 to 35° C. or 20 to 25° C. These temperature ranges have been found to provide increased stability to the composition as compared to water that is closer in temperature to the molten esterquat (about 55° C.). In certain embodiments, the temperature of the water in step c) is equal to or less than the temperature of the water in step a).

In certain embodiments, in step a) from 7.5 to 15 units of water are provided and in step c) from 85 to 92.5 units of water are provided. Further optionally, in step a) about 10 units of water are provided and in step c) about 90 units of water are provided.

In certain embodiments, in step b) the dispersion is carried out so that the particles have an average particle size of from 1 to 50 microns, further optionally from 10 to 25 microns.

In certain embodiments, in step b) the dispersion is carried out so that the particles have a particle size distribution exhibiting plural peaks at respective different particle sizes. Further optionally, in step b) the dispersion is carried out so that the particle size distribution exhibits two peaks at, respectively, particles sizes of about 2 to 3 microns and 10 to 20 microns.

In certain embodiments, in step b) the dispersion is carried out for a period of from 1 to 4 minutes using a shearing mixer to form the emulsion.

In certain embodiments, in step b) the esterquat is dispersed into the water in the form of a molten liquid. Optionally, in step b) the cationic surfactant is dispersed into the water in the form of an aqueous solution of the cationic surfactant. Optionally, in step b) the cationic surfactant is added before the esterquat.

In certain embodiments, the method is for producing a fabric softener composition.

The present invention also provides a method of softening a fabric comprising treating the fabric with a composition of the invention or produced by a method of the invention.

In certain embodiments, the composition further comprises a fragrance and the method provides fragrance delivery onto the fabric.

The present invention also provides the use of a composition of the invention or produced by a method of the invention as a fabric softener.

The composition can contain any material that can be added to fabric softeners. Examples of materials include, but are not limited to, surfactants, thickening polymers, colorants, clays, buffers, silicones, fatty alcohols, and fatty esters.

SPECIFIC EMBODIMENTS OF THE INVENTION

The invention is further described in the following examples. The examples are merely illustrative and do not in any way limit the scope of the invention as described and claimed.

Examples 1 to 4

In Examples 1 to 4 fabric conditioner compositions based on triethanol amine tallow fatty acid triesterquat were prepared.

In each of Examples 1 to 3, a first volume of deionized water was provided at a given temperature. Then the quaternary cationic surfactant was added to the deionized water. The quaternary cationic surfactant comprised an aqueous solution of a C16 monoalkyl quaternary ammonium cationic surfactant, having 60 wt % active content. The surfactant was added in an amount so as to comprise 0.37 wt % of the final composition. The resultant solution was mixed using a high shear mixer. Then molten liquid esterquat, comprising at least 90 wt % triesterquat and less than 1 wt % monoesterquat, was added to the mixing aqueous solution, followed by fragrance. Such an esterquat having high triesterquat content is available in commerce from Kao Corporation. The triesterquat was added in an amount so as to comprise 2.4 wt % of the final composition. The fragrance was added in an amount so as to comprise 0.5 wt % of the final composition. Finally, a second volume of water was added to make the final composition. The resultant mixture was mixed using the high shear mixer for a further period of 4 minutes. This formed in each of Examples 1 to 3 an aqueous emulsion of particles of a mixture of the triesterquat and the cationic surfactant.

In Examples 1 to 3, the following method parameters were varied: the amount of the first and second volumes of water; and the temperature of the first and second volumes of water.

Example 4 was modified as compared to Examples 1 to 3 by initially providing a single volume of water at a temperature of 55° C., comprising 100% of the water in the composition, to which all of the ingredients were added as described above. This also formed in Example 4 an aqueous emulsion of particles of a mixture of the triesterquat and the cationic surfactant.

These different parameters of the production method are summarized in Table 1.

TABLE 1

| | Initial Water Temp | Initial Water Amount | Final Water Temp | Final Water Amount | Average Particle Size (μm) | Normalized Day 1 Fragrance | Normalized Softness |
|---|---|---|---|---|---|---|---|
| Example 1 | Room temp | 10% | Room temp | 90% | 20 | 0.80 | 0.93 |
| Example 2 | 55° C. | 10% | Room temp | 90% | 31 | 0.76 | 0.58 |
| Example 3 | 55° C. | 70% | Room temp | 30% | 40 | 0.75 | 0.33 |
| Example 4 | 55° C. | 100% | n/a | n/a | 32 | 0.69 | 0.40 |

In Table 1, room temperature means 20-25° C.

The emulsion of each Example was tested to determine the average particle size in the emulsion. All particle size measurements were carried out using a Malvern 2000 Mastersizer. The volume average particle size is reported. The results are also shown in Table 1. The emulsion of each Example was also tested to determine the ability of the composition to deliver fragrance onto fabric on day one and to soften the fabric. These results are also shown in Table 1. The performance of the formulations was tested according to the following protocol:

Protocol

Full Load Wash in Standard US Type Washer

Each experiment used 79 grams product added to the rinse after a wash cycle with 90 grams anionic surfactant based detergent. The fabric load consisted of 12 terry had towels (approximately 1.4 Kg) and a mixed clothing load (approximately 1.6 Kg). There was a 15 minute wash cycle and a 4 minute rinse cycle. All terry towels were line dried. A subset of the towels were cut into smaller pieces and evaluated by a trained sensory panel for their fragrance intensity on a scale from 1 to 10. Whole towels were folded and evaluated by a trained sensory panel for their softness intensity on a scale from 1 to 10. Positive (a current commercial fabric softener product) and negative (no softener in rinse) controls were used in the screening tests. Each experiment consisted of the positive and negative controls and 4 experimental products. The rated performance of the positive control can vary somewhat from day to day showing variability of both performance and rating from day to day. Therefore to be able to more easily compare products tested on different days all the results were normalized by the following equation: Normalized Value=(Value of Experimental Product−Value of Negative Control)/(Value of Positive Control−Value of Negative Control). All performance data is expressed as this normalized value.

Table 1 shows that for Example 1, which provided 10% water as the first volume and 90 wt % water as the second volume, the water of both the first and second volumes was at room temperature, the particle size was small at 20 microns and the normalized fragrance and softness values were high.

In Example 2, which also provided 10% water as the first volume, 90 wt % water as the second volume, and the water of the second volume being at room temperature, the water of the first volume was not at room temperature, but instead at the higher temperature of 55° C. In this Example 2, the particle size was larger than in Example 1 at 31 microns, the normalized fragrance value was slightly lower than in Example 1 and the softness value was rather lower than in Example 1.

In Example 3, which also provided 70% water as the first volume, 30 wt % water as the second volume, the water of the second volume being at room temperature, and the water of the first volume being at 55° C., the particle size was larger than in Example 2 at 40 microns, the normalized fragrance value was slightly lower than in Example 2 and the softness value was rather lower than in Example 2.

In Example 4, which provided 100% water as the first volume, with no water as the second volume, and the water of the first volume being at 55° C., the particle size was slightly larger than in Example 2 at 32 microns, the normalized fragrance value was slightly lower than in Example 2 and the softness value was rather lower than in Example 2.

Although the fragrance delivery was very similar in Examples 1 to 4, there was variability in the softness. Example 1 exhibited the best softening and fragrance performance of these Examples, and in Example 1 all of the water used in the process was at room temperature and only 10% of the water was present when the ingredients were mixed.

For the four formulations of Examples 1 to 4, particle sizes were measured and there are three main peaks: the 2 μm area, the 15 μm area, and the 50 μm area. For each formula the peaks have different relative sizes signifying different volume amounts of the triesterquat/quaternary ammonium cationic surfactant particle sizes in each particle size area.

Without being bound by any theory, it is believed that the best performing esterquat product, for Example 1 which produced the best softening performance coupled with fragrance delivery, has nearly equal amounts in each peak area for the respective particle sizes.

Examples 5 to 9

In Examples 5 to 9 fabric conditioner compositions based on triethanol amine tallow fatty acid triesterquat were prepared in a manner similar to Example 4. All of the esterquat, cationic surfactant and fragrance ingredients were added to a single volume of water at a temperature of 55° C., comprising 100% of the water in the composition, which was subjected to mixing by a high shear mixer.

In each of Examples 5 to 9, as shown in Table 2, different amounts of the triesterquat and the quaternary cationic surfactant were provided. Again, the esterquat comprised at least 90 wt % triesterquat and less than 1 wt % monoesterquat and the quaternary cationic surfactant comprised an aqueous solution of a C16 monoalkyl quaternary cationic surfactant. The fragrance amount was again 0.5 wt %.

The particle size, fragrance delivery on day one and softness were tested as for Examples 1 to 4 and the results are shown in Table 2.

TABLE 2

| | Formula (active levels) | Average Particle Size (μm) | Normalized Day One Fragrance | Normalized Softness |
|---|---|---|---|---|
| Example 5 | 1.8 wt % Triesterquat/ 0.44 wt % cationic surfactant | 10 | 0.94 | 0.56 |
| Example 6 | 1.9 wt % Triesterquat/ 0.41 wt % cationic surfactant | 16 | 0.79 | 0.40 |
| Example 7 | 2.4 wt % Triesterquat/ 0.44 wt % cationic surfactant | 21 | 0.79 | 0.66 |
| Example 8 | 2.4 wt % Triesterquat/ 0.37 wt % cationic surfactant | 32 | 0.92 | 0.67 |
| Example 9 | 2.8 wt % Triesterquat/ 0.40 wt % cationic surfactant | 41 | 0.66 | 0.61 |

From Table 2, it may be seen that compositions that comprise from 1.8 to 2.8 wt % triesterquat, based on the weight of the composition, provide softening and fragrance delivery.

The composition comprised from 0.25 to 0.5 wt % quaternized cationic surfactant, typically from 0.3 to 0.45 wt % quaternized cationic surfactant, based on the weight of the composition, to provide softening and fragrance delivery. When the composition comprised about 0.35 wt % quaternized cationic surfactant, based on the weight of the composition, particularly good softness and fragrance delivery was achieved. The formula of Example 8 including 2.4 wt % triesterquat and 0.37 wt % C16 quaternary ammonium cationic surfactant provided particularly good softening and fragrance delivery, giving the same fragrance delivery as the control esterquat formula and consumer acceptable softening performance. Therefore the formulations of Examples 5 to 9, and the formulation of Example 8 in particular, gave acceptable fragrance and softening performance at minimum esterquat cost.

Examples 10 to 13

For Examples 10 and 12, a first volume of deionized water was provided at 36° C. Then the quaternary cationic surfactant was added to the deionized water. The quaternary cationic surfactant comprised an aqueous solution of a C16 monoalkyl quaternary ammonium cationic surfactant, having 60 wt % active content. As shown in Table 3, different amounts of the quaternary cationic surfactant were provided. The resultant solution was mixed using a high shear mixer. Then molten liquid esterquat, comprising at least 90 wt % triesterquat and less than 1 wt % monoesterquat, was added to the mixing aqueous solution, followed by fragrance. The triesterquat was added in an amount so as to comprise 2.4 wt % of the final composition. The fragrance was added in an amount so as to comprise 0.5 wt % of the final composition. Finally, a second volume of water at a given temperature was added to make the final composition. The resultant mixture was mixed using the high shear mixer for a further period of 4 minutes.

Example 11 was prepared as in the method for Examples 10 and 12 except that the fragrance and the cationic surfactant were blended with the molten esterquat before addition to the water.

Example 13 was prepared as in the method for Examples 10 and 12 except that the fragrance was added to the molten esterquat before addition to the water.

The particle size, fragrance delivery on day one and softness were tested as for Examples 1 to 4 and the results are shown in Table 3.

TABLE 3

| | Cationic Surfactant (active levels) | Water Temperature (second volume ° C.) | Average Particle Size (μm) | Normalized Day One Fragrance | Normalized Softness |
|---|---|---|---|---|---|
| Example 10 | 0.24 wt % | 26 | 24 | 1.10 | 0.59 |
| Example 11 | 0.72 wt % | 36 | 16 | 0.89 | 0.90 |
| Example 12 | 0.60 wt % | 36 | 4 | 0.72 | 0.69 |
| Example 13 | 0.37 wt % | 36 | 20 | 0.86 | 1.10 |

From Table 3 it can be seen that by adjusting the process conditions, different levels of performance can be produced. Not all consumers desire the same level of fragrance delivery and/or softness. By adjusting process parameters higher and lower levels of softening and fragrance delivery can be achieved. It can also be seen that softening and fragrance delivery in these emulsions do follow the same trends; it is possible to produce a sample with lower fragrance delivery but higher softness and vice versa.

The Examples in Table 3 give similar performance to those in Table 1 and Table 2 and are therefore also in the range of acceptable fragrance and softening performance at minimum esterquat cost.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

We claim:

1. A composition comprising (a) an esterquat that is a quaternized reaction product of an alkanol amine and a fatty acid, wherein from at least 90 wt % to up to 100 wt % of the esterquat is comprised of triesterquat and from 0 wt % to up to 10 wt % of the esterquat is comprised of at least one of monoesterquat and diesterquat, and (b) a cationic surfactant comprising a formula $RNH_3^+X^-$ where R is alkyl group having from 10 to 22 carbon atoms and $X^-$ is a softener compatible anion.

2. The composition of claim 1, wherein from 0 wt % to up to 5 wt % of the esterquat is comprised of monoesterquat.

3. The composition of claim 1, wherein the alkanol amine comprises triethanol amine.

4. The composition of claim 1, wherein the fatty acid comprises fatty acid from tallow.

5. The composition of claim 1, wherein the esterquat is present in an amount of 0.01 to 35% by weight of the composition.

6. The composition of claim 1, wherein the composition comprises from 0.25 to 0.75 wt % cationic surfactant, based on the weight of the composition.

7. The composition of claim 1, wherein the weight ratio of triesterquat to cationic surfactant is from 20:1 to 3:1.

8. The composition of claim 1, further comprising a solvent.

9. The composition of claim 8, wherein the triesterquat is dispersed as an emulsion in the solvent, and the emulsion comprises particles including a mixture of the triesterquat and the cationic surfactant.

10. The composition of claim 9, wherein the particles have an average particle size of from 1 to 50 microns.

11. The composition of claim 9, wherein the particles have a particle size distribution exhibiting plural peaks at respective different particle sizes.

12. The composition of claim 11, wherein the particle size distribution exhibits at least two peaks at, respectively, particle sizes of 2 to 3 microns and 10 to 20 microns.

13. The composition of claim 11, wherein the particle size distribution exhibits two peaks at, respectively, particles sizes of about 2 microns and about 15 microns.

14. The composition of claim 11, wherein the plural peaks of the particle size distribution each have an apparent particle population that is similar to the other peaks.

15. The composition of claim 1, which is a fabric softener composition.

16. A method of producing a composition according to claim 1, the method comprising the steps of:

a) providing from 5 to 25 units by volume of water at a temperature of from 20 to 45° C.;

b) dispersing the esterquat and the cationic surfactant into the water to form an aqueous emulsion comprising particles including a mixture of the triesterquat and the cationic surfactant; and c) adding to the aqueous emulsion from 75 to 95 units by volume of water at a temperature of from 20 to 45° C. to produce the composition.

17. The method of claim 16, wherein in step a) the water is at a temperature of from 20 to 35° C.

18. The method of claim 16, wherein in step c) the water is at a temperature of from 20 to 35° C.

19. The method of claim 16, wherein the temperature of the water in step c) is equal to or less than the temperature of the water in step a).

20. The method of claim 16, wherein in step a) from 7.5 to 15 units of water are provided and in step c) from 85 to 92.5 units of water are provided.

21. The method of claim 16, wherein in step b) the dispersion is carried out so that the particles have an average particle size of from 1 to 50 microns.

22. The method of claim 16, wherein in step b) the dispersion is carried out so that the particles have a particle size distribution exhibiting plural peaks at respective different particle sizes.

23. The method of claim 22, wherein in step b) the dispersion is carried out so that the particle size distribution exhibits at least two peaks at, respectively, particle sizes of 2 to 3 microns and 10 to 20 microns.

24. The method of claim 22, wherein in step b) the dispersion is carried out so that wherein the particle size distribution exhibits three peaks at, respectively, particles sizes of about 2 microns, about 15 microns and about 50 microns.

25. The method of claim 22, wherein in step b) the dispersion is carried out so that the plural peaks of the particle size distribution each have an apparent particle population that is similar to the other peaks.

26. The method of claim 16, wherein in step b) the dispersion is carried out for a period of from 1 to 4 minutes using a shearing mixer to form the emulsion.

27. The method of claim 16, wherein in step b) the esterquat is dispersed into the water in the form of a molten liquid.

28. The method of claim 16, wherein in step b) the cationic surfactant is dispersed into the water in the form of an aqueous solution of the cationic surfactant.

29. The method of claim 16, wherein a fragrance is blended with the esterquat prior to blending with the cationic surfactant.

* * * * *